US006517188B1

(12) United States Patent
Hawkins et al.

(10) Patent No.: US 6,517,188 B1
(45) Date of Patent: Feb. 11, 2003

(54) INK JET PRINT HEAD CLEANING

(75) Inventors: Gilbert A. Hawkins, Mendon, NY (US); Michael E. Meichle, Rochester, NY (US); Ravi Sharma, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 48 days.

(21) Appl. No.: 09/641,107

(22) Filed: Aug. 17, 2000

Related U.S. Application Data

(63) Continuation-in-part of application No. 09/599,472, filed on Jun. 22, 2000.

(51) Int. Cl.[7] ..... B41J 2/165
(52) U.S. Cl. ..... 347/34
(58) Field of Search ..... 347/21, 22, 28, 347/31, 32, 33, 34, 36

(56) References Cited

U.S. PATENT DOCUMENTS 5,688,060 A 11/1997 Terao
6,083,489 A * 7/2000 Fischer et al. ..... 424/52
6,142,601 A * 11/2000 Sharma et al. ..... 347/28
6,196,657 B1 * 3/2001 Hawkins et al. ..... 347/28

FOREIGN PATENT DOCUMENTS

| | | | |
|---|---|---|---|
| EP | 1 005 997 A | 6/2000 | |
| EP | 1167043 A1 * | 2/2002 | ..... B41J/2/165 |
| JP | 04 146997 | 5/1992 | |
| JP | 11 152499 | 6/1999 | |
| JP | 11 334091 | 12/1999 | |
| JP | 2000-311877 * | 7/2000 | ..... H01L/021/304 |

* cited by examiner

*Primary Examiner*—Anh T. N. Vo
(74) *Attorney, Agent, or Firm*—Milton S. Sales

(57) ABSTRACT

A self-cleaning printer includes a print head having a surface that is susceptible to a contaminate build up. A cleaning liquid containing a concentration of macroscopic cleaning particles is flowed in frictive contact with the contaminate such that a combined effect of frictive force and hydrodynamic shearing force acting on the contaminate effectively removes the contaminate from the surface. Preferably, the cleaning particles are adapted to attach to the contaminate. They may include polymeric beads such as polystyrene spheres. The cleaning particles preferably have surfaces to which polymeric chains are attached, the polymeric chains having end groups which adhere to the contaminate.

33 Claims, 12 Drawing Sheets

INK JET PRINT HEAD CLEANING

CROSS REFERENCE TO RELATED APPLICATIONS

This is a continuation-in-part of U.S. Ser. No. 09/599,472, filed Jun. 22, 2000, entitled INK JET PRINT HEAD CLEANING by Gilbert A. Hawkins et al.

FIELD OF THE INVENTION

This invention generally relates to ink jet printer apparatus and methods and more particularly relates to apparatus and methods for cleaning a print head.

BACKGROUND OF THE INVENTION

An ink jet printer produces images on a receiver by ejecting ink droplets onto the receiver in an imagewise fashion. So called "continuous" ink jet printers utilize electrostatic charging tunnels that are placed close to the point where ink droplets are being ejected in the form of a stream. Selected ones of the droplets are intercepted downstream, while other droplets are free to strike a recording medium. In the case of "drop on demand" ink jet printers, ink droplets are ejected from selected nozzle orifices only when needed.

Of course, the ink jet print head, whether of the "continuous" or "drop on demand" type, is exposed to the environment at the nozzle orifice opening, which are exposed to many kinds of air born particulates. Particulate debris may accumulate on surfaces formed around the orifices and may accumulate in the orifices and ink ejection chambers themselves. The ink may combine with such particulate debris to form an interference burr that blocks the orifice or that alters surface wetting to inhibit proper formation of the ink droplet. The particulate debris should be cleaned from the surface and orifice to restore proper droplet formation. In the prior art, this cleaning is commonly accomplished by brushing, wiping, spraying, vacuum suction, and/or spitting of ink through the orifice.

An ink jet print head cleaner is disclosed in U.S. Pat. No. 4,970,535 titled "Ink Jet Print Head Face Cleaner" issued Nov. 13, 1990, in the name of James C. Oswald, wherein heated air is directed past ink jet apertures on the head face and then out an outlet. However, use of heated air is believed to be less effective for cleaning than use of a liquid solvent. Also, use of heated air may damage fragile electronic circuitry that may be present on the print head face.

U.S. Pat. No. 4,600,928 by Braun et al., issued Jul. 15, 1986, teaches an ultrasonic self-cleaning system for cleaning of a print head assembly wherein ink is supported in approximation to the orifices of the print head by capillary force. Ultrasonic cleaning pulses are then applied to clean the surface through fluid transmission of that ultrasound energy to said surface.

U.S. Pat. No. 5,574,485 by Anderson et al., issued Nov. 12, 1996, discloses the use of ultrasonic energy in conjunction with a cleaning fluid to dislodge dried ink particles from a print head surface. However, this system requires a relatively complex cleaning station including apparatus for scanning the liquid wiper across the print head surface.

Therefore, there is a need to provide a self-cleaning printer and method of assembling same, which self-cleaning printer provides effective cleaning without complex cleaning station apparatus.

SUMMARY OF THE INVENTION

According to a feature of the present invention, a self-cleaning printer includes a print head having a surface that is susceptible to a contaminate build up. A cleaning liquid containing a concentration of macroscopic cleaning particles is flowed in frictive contact with the contaminate, during which forces are exerted on the contaminant by contact between the contaminant and at least one cleaning particle and energy is exchanged by contact between the contaminant and the cleaning particle, such that a combined effect of frictive force and the hydrodynamic shearing force of the liquid acting on the contaminate effectively removes the contaminate from the surface.

Preferably, the cleaning particles are adapted to attach to the contaminate. They may include polymeric beads such as polystyrene spheres. The cleaning particles preferably have surfaces to which polymeric chains are attached, the polymeric chains having end groups which adhere to the contaminate.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
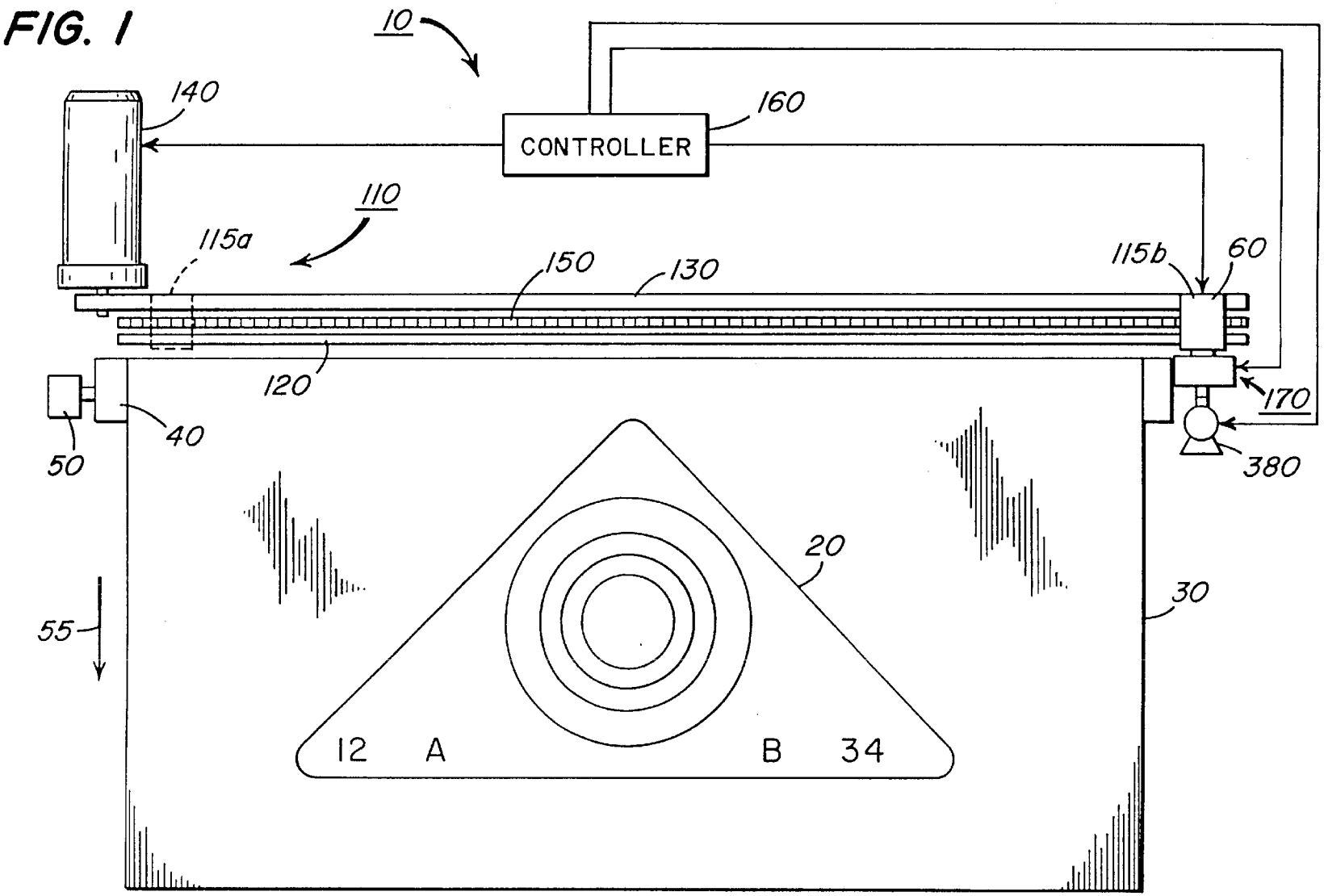
FIG. 1 is an elevation view of a self-cleaning ink jet printer according to the present invention, the printer including a print head.
Figure 2:
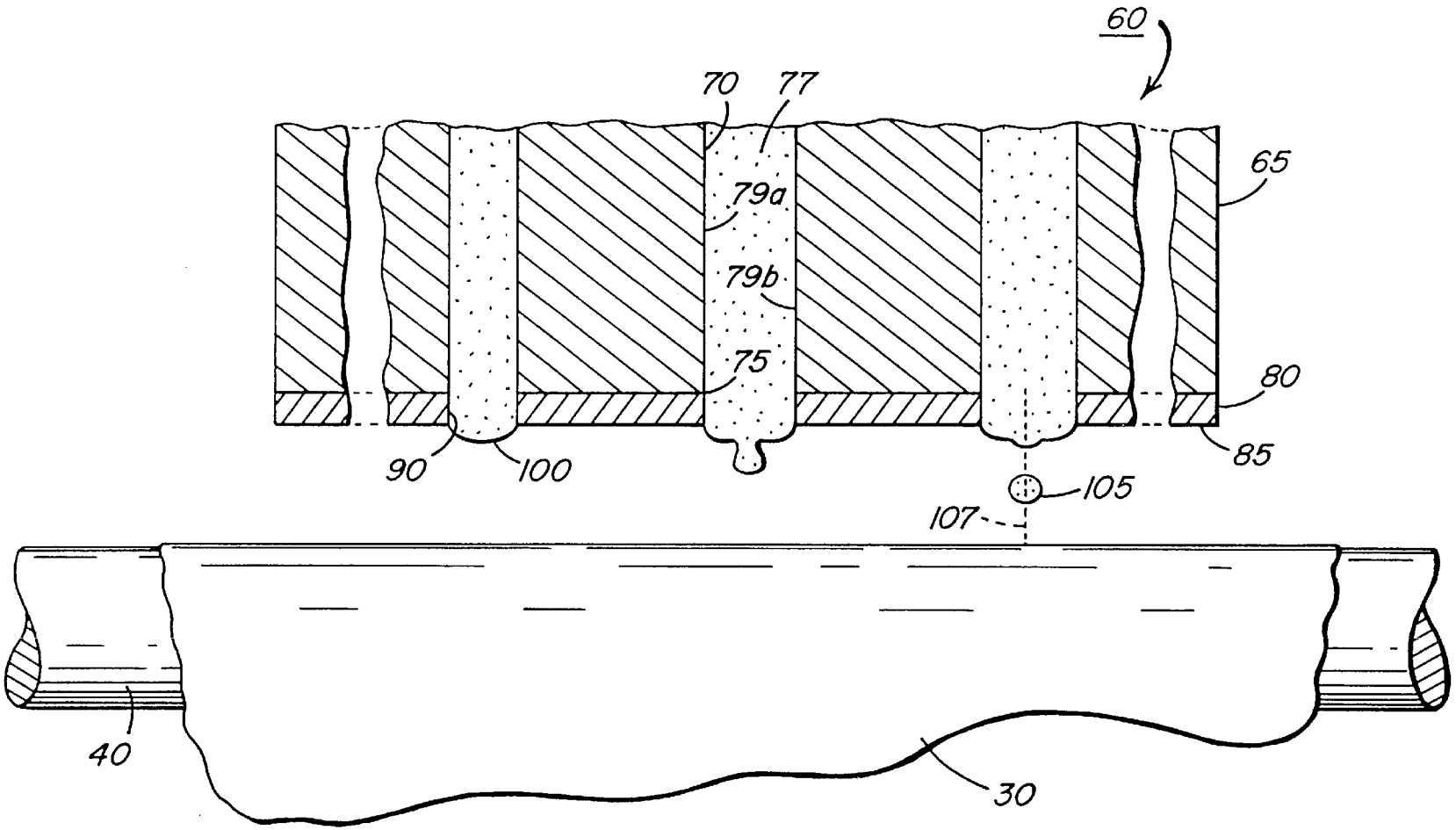
FIG. 2 is a fragmentation view in vertical section of the print head, the print head defining a plurality of channels therein, each channel terminating in an orifice.

FIGS. 1 and 2 show a self-cleaning printer 10 for printing an image 20 on a receiver 30 supported on a platen roller 40 rotated by a motor 50 to advance the receiver in direction illustrated by first arrow 55. A print head 60 comprises a print head body 65 having a plurality of ink channels 70, each terminating in a channel outlet 75. Channels 70 are adapted to hold an ink body 77, and are defined by oppositely disposed parallel side walls 79*a* and 79*b*. A cover plate 80 has a plurality of orifices 90 formed there through to colinearly align with respective ones of channel outlets 75, such that each orifice 90 faces receiver 30. A surface 85 of cover plate 80 surrounds all orifices 90 and also faces receiver 30. The printer may be of drop on demand or continuous technology. In any case, ink droplets 105 are preferably ejected along a first axis 107 normal to surface 85.

A transport mechanism 110 reciprocates print head 60 between a first position 115*a* (shown in phantom) and a second position 115*b* along an elongate guide rail 120 parallel to platen roller 40. Transport mechanism 110 includes a drive belt 130 attached to print head 60. A reversible motor 140 engages belt 130, such that belt 130 reciprocates. An encoder strip 150 coupled to print head 60 monitors the position of the print head along guide rail 120. A controller 160 is connected to platen roller motor 50, drive belt motor 140, encoder strip 150 and print head 60 for controlling operation thereof to suitably form image 20 on receiver 30.

Figure 3:
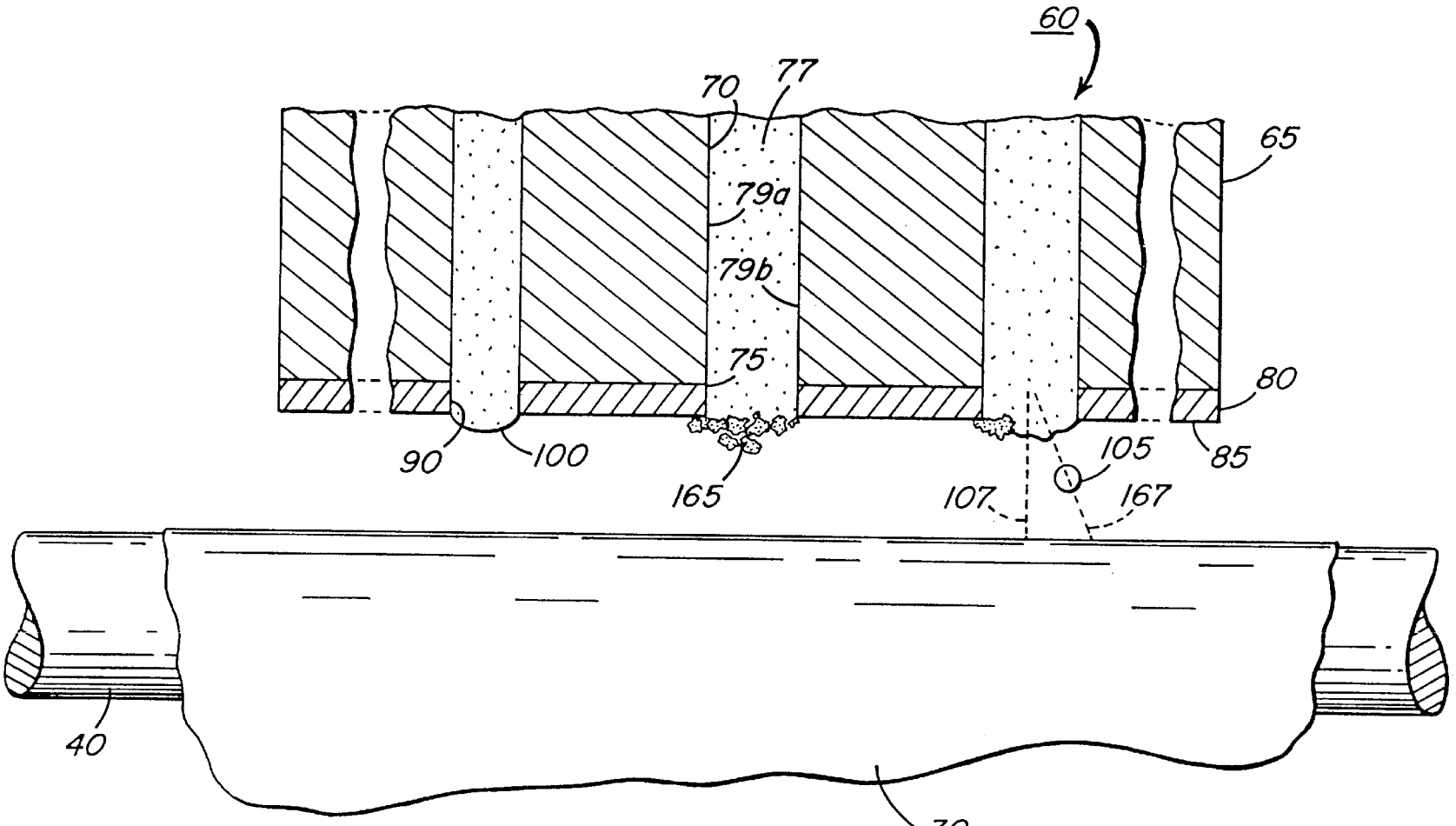
FIG. 3 is a fragmentation view in vertical section of the print head, this view showing some of the orifices encrusted with contaminate to be removed.

Referring to FIG. 3, cover plate 80 may become contaminated by contaminate 165 which will reside on surface 85. Such contaminate may partially or completely obstruct orifice 90. Contaminate 165 may be, for example, particles of dirt, dust, metal and/or encrustations of dried ink. Presence of contaminate 165 may fully or partially obstruct orifice 90 to prevent ink from being ejected or divert the droplets from first axis 107, causing them to travel along a second axis 167. If ink droplet 105 travels along second axis 167, the droplet will land on receiver 30 in an unintended location. In this manner, such complete or partial obstruction of orifice 90 leads to printing artifacts such as "banding", a highly undesirable result. Also, presence of contaminate 165 may alter surface wetting and inhibit proper formation of droplet 105. Therefore, it is desirable to clean (i.e., remove) contaminate 165 to avoid printing artifacts.

Figure 4:
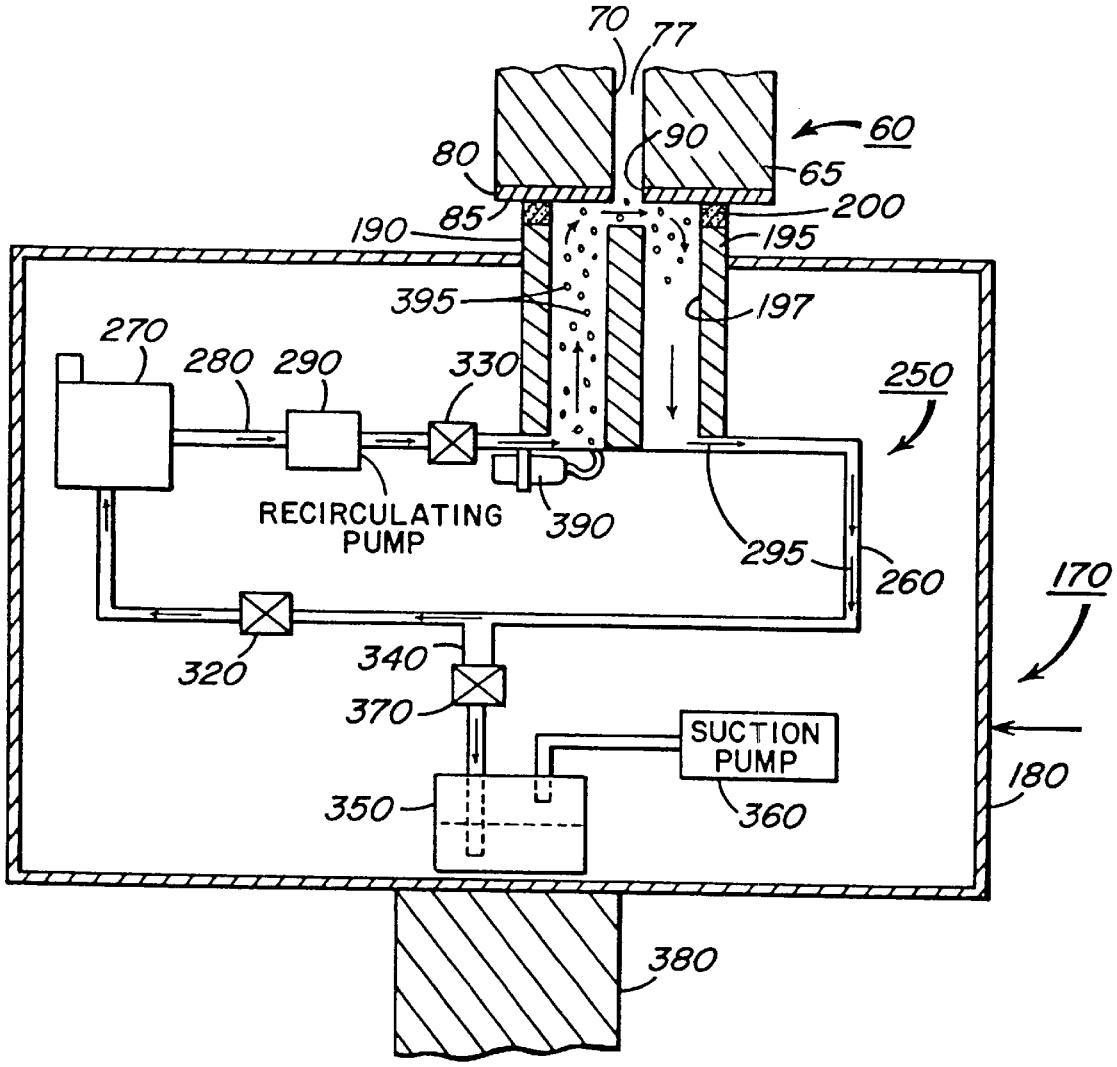
FIG. 4 is a view in vertical section of a cleaning assembly for removing the contaminate.
Figure 5:
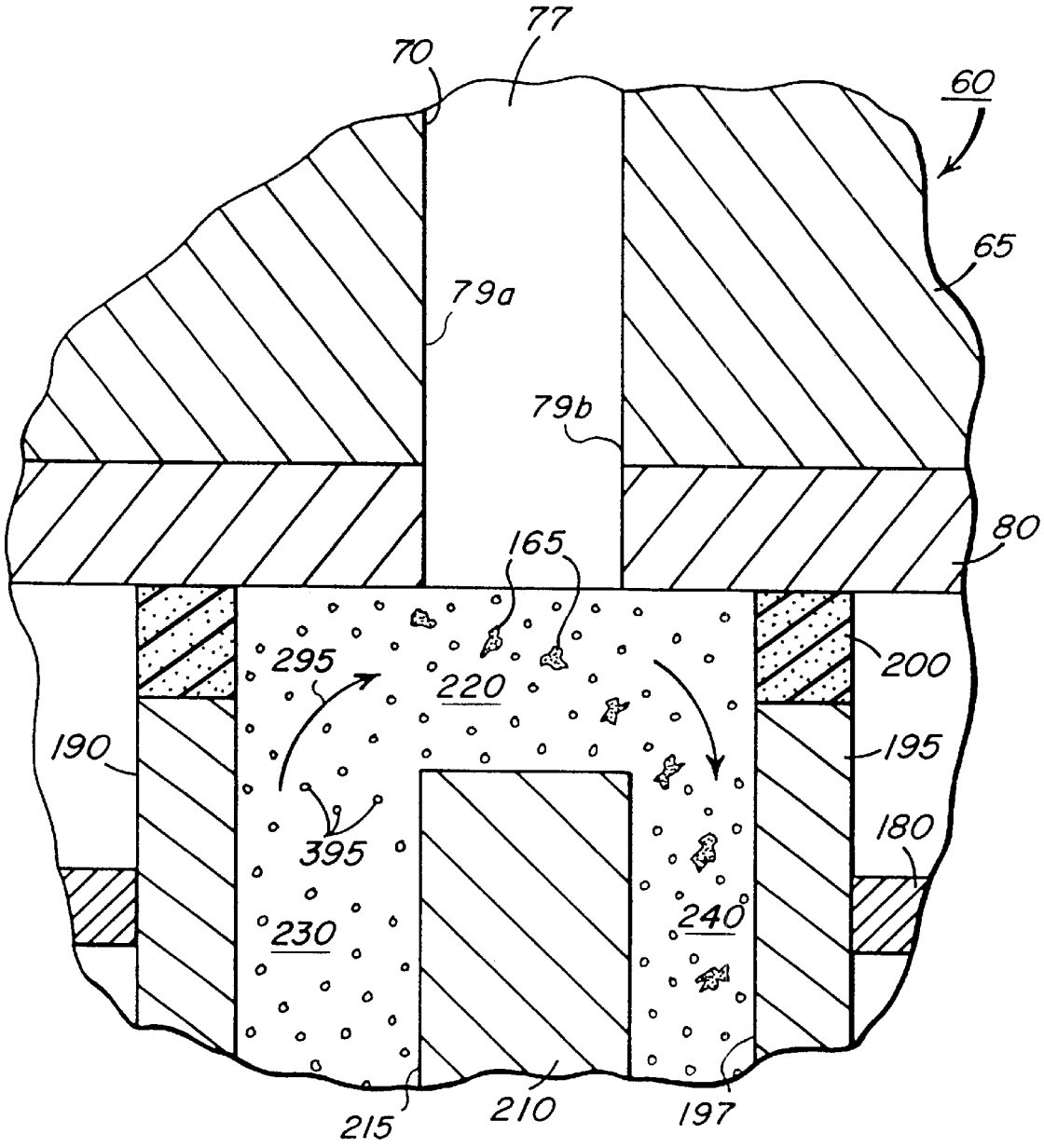
FIG. 5 is an enlarged fragmentation view in vertical section of the cleaning assembly.

Referring to FIGS. 1, 4 and 5, a cleaning assembly 170 is disposed proximate surface 85 for directing a flow of cleaning liquid along surface 85 and across orifice 90 to clean contaminate 165 therefrom while print head 60 is disposed at second position 115*b*. Cleaning assembly 170 includes a housing 180 with a cup 190 having an open end 195 and defining a cavity 197 communicating with open end 195. Attached to open end 195 is an elastomeric seal 200 encircling one or more orifices 90 and sealingly engaging surface 85.

A structural member, such as an elongate septum 210, extends along cavity 197 perpendicularly opposite orifices 90. Septum 210 has an end portion 215 which defines a gap 220 defined between surface 85 and end portion 215. Gap 220 is sized to allow flow of a liquid there through in order to clean contaminate 165 from surface 85 and/or orifice 90. By way of example only, and not by way of limitation, the velocity of the liquid through gap 220 may be about 1 to 20 meters per second. Also by way of example only, and not by way of limitation, height of gap 220 may be approximately 3 to 30 thousandths of an inch with a preferred gap height of approximately 5 to 20 thousandths of an inch. Moreover, hydrodynamic pressure applied to the liquid in the gap due, at least in part, to presence of septum 210 may be approximately 1 to 30 psi (pounds per square inch). Septum 210, partitions (i.e., divides) cavity 197 into an inlet chamber 230 and an outlet chamber 240, for reasons described more fully hereinbelow. Although a septum is preferred to enhance the flow rate of liquids in the vicinity of orifices 90, its use is not required in the practice of the current invention, since other means of increasing the rate of flow of the cleaning liquid exist, for example the rate may be increased by increasing the fluid pressure at the inlet 230.

The cleaning liquid may be any suitable liquid solvent composition, such as water, isopropanol, diethylene glycol, diethylene glycol monobutyl ether, octane, acids and bases, surfactant solutions and a combination thereof. Complex liquid compositions may also be used, such as microemulsions, micellar surfactant solutions, vesicles and solid particles dispersed in the liquid. The cleaning liquid carries a high concentration of macroscopic cleaning particles 395 which are described below with respect to FIGS. 10 and 11.

A closed-loop piping circuit 250 interconnects inlet chamber 230 and outlet chamber 240. Piping circuit 250 is in fluid communication with gap 220 for recycling liquid through gap 220. Piping circuit 250 includes a first piping segment 260 extending from outlet chamber 240 to a reservoir 270 containing a supply of the liquid. Piping circuit 250 further includes a second piping segment 280 extending from reservoir 270 to inlet chamber 230. A recirculation pump 290 is disposed in second piping segment 280 for pumping the liquid from reservoir 270, through second piping segment 280, into inlet chamber 230, through gap 220, into outlet chamber 240, through first piping segment 260 and back to reservoir 270, as illustrated by a plurality of second arrows 295.

A first valve 320 in first piping segment 260 is operable to block flow of the liquid through first piping segment 260. A second valve 330 in second piping segment 280 is operable to block flow of the liquid through second piping segment 280. First valve 320 and second valve 330 are located so as to isolate cavity 197 from reservoir 270. A third piping segment 340 has an open end thereof connected to first piping segment 260 and another open end thereof received into a sump 350. In communication with sump 350 is a suction (i.e., vacuum) pump 360. A third valve 370 operable to isolate piping circuit 250 from sump 350 is disposed in third piping segment 340.

During operation of cleaning assembly 170, first valve 320 and second valve 310 are opened while third valve 370 is closed. Recirculation pump 290 is then operated to draw the liquid from reservoir 270 and into inlet chamber 230. The liquid will then flows through gap 220. However, as the liquid flows through gap 220 a hydrodynamic shearing force will be induced in the liquid due to presence of end portion 215 of septum 210 and macroscopic cleaning particles 395 are carried into frictive contact with contaminate 165. Contact with the contaminants removes most contaminants by physically dislodging them. If the cleaning particles bond, either momentarily or permanently, to the contaminants, the flow of the rest of the cleaning solution exerts a force on the cleaning particle that is transmitted to the contaminant and helps dislodge it. If the contaminant is dislodged, it is swept away in the flow of cleaning fluid, whether or not it is bonded to the cleaning particles. If the contaminants are only weakly lodged on the printhead surfaces or if the size of the cleaning particles is sufficiently large, use of septum 210 is not required in the practice of the current invention.

The combined effect of the frictive force and the hydrodynamic shearing force acting on contaminate 165 effectively removes contaminate 165 from surface 85 and/or orifice 90, so that contaminate 165 becomes entrained in the liquid flowing through gap 220. Preferably, frictive contact is achieved with both surface 85 and the inner surfaces of orifice 90. The cleaning liquid preferably carries away both the cleaning particles and the contaminants on the print head. As contaminate 165 is cleaned from surface 85 and orifice 90, the liquid with contaminate 165 entrained therein, flows into outlet chamber 240 and from there into first piping segment 260. As recirculation pump 290 continues to operate, the liquid with entrained contaminate 165 flows to reservoir 270 from where the liquid is pumped into second piping segment 280. After a desired amount of contaminate 165 is cleaned from surface 85 and/or orifice 90, recirculation pump 290 is caused to cease operation and first valve 320 and second valve 330 are closed to isolate cavity 197 from reservoir 270. At this point, third valve 370 is opened and suction pump 360 is operated to substantially suction the liquid from first piping segment 260, second piping segment 280 and cavity 197. This functioned liquid flows into sump 350 for later disposal. Alternatively, after a desired amount of contaminate 165 is cleaned from surface 85 and/or orifice 90, a fluid having no solid cleaning particles can be circulated over gap 220, for example by exchanging reservoir 270 for one containing a fluid having no cleaning particles in order to flush out all contaminants and cleaning particles from the region around gap 220 and from the associated piping 260, 280.

Returning to FIG. 1, an elevator 380 maybe connected to cleaning assembly 170 for elevating cleaning assembly 170 so that seal 200 sealingly engages surface 85 when print head 60 is at second position 115*b*. To accomplish this result, elevator 380 is connected to controller 160, so that operation of elevator 380 is controlled by controller 160. Of course, when the cleaning operation is completed, elevator 380 may be lowered so that seal no longer engages surface 85.

Previously-discussed embodiments of the present invention deal with apparatus and process for external cleaning of a print head. The following embodiments related to internal cleaning of the nozzle bores, including the region where cleaning liquid drops are expelled through the nozzles, and to a combination of simultaneous external cleaning and internal cleaning.

Figure 6A:
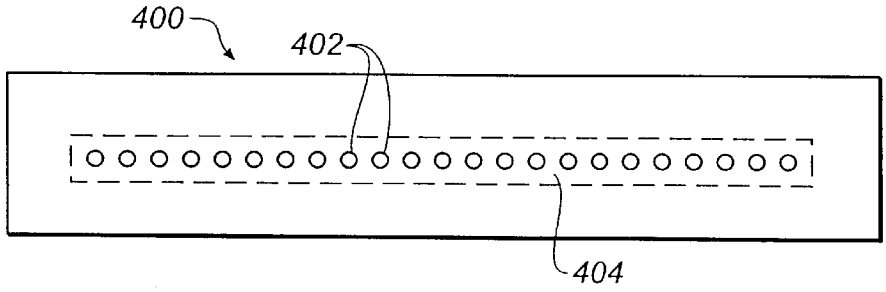
FIGS. 6*a*–6*c* show an inkjet print head of the continuous type in bottom view, side view and end view.
Figure 6B:
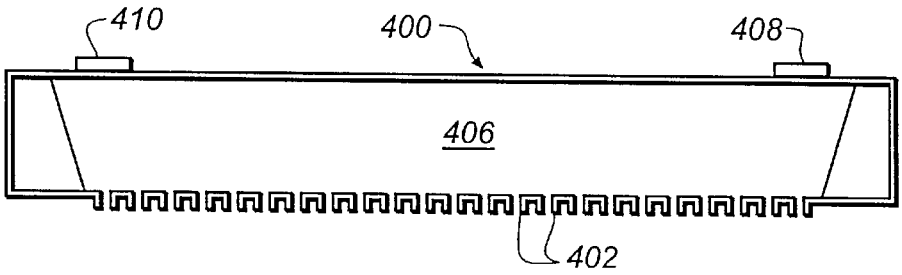
Figure 6C:
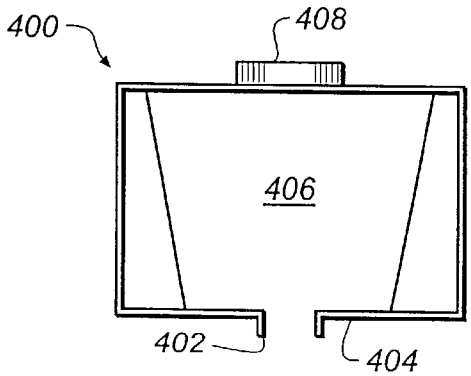
Figure 7A:
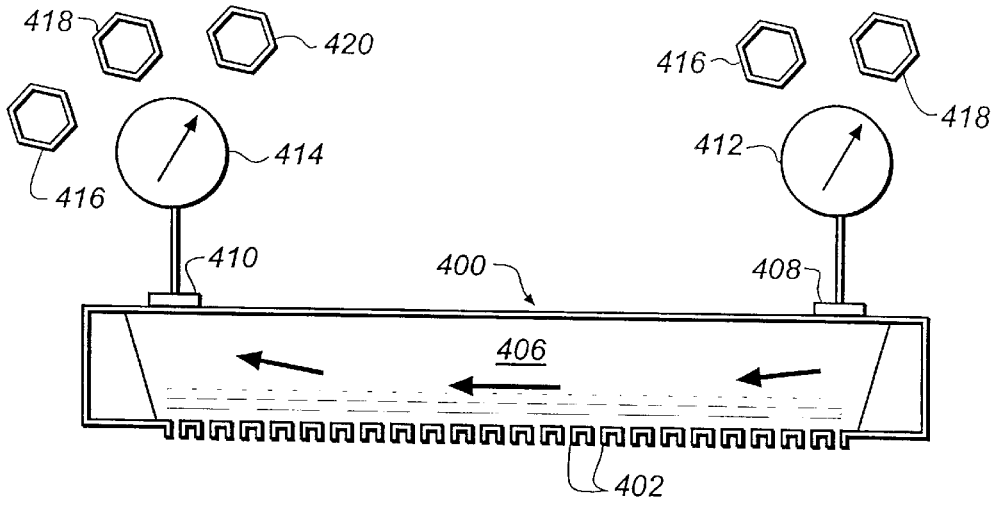
FIGS. 7*a*–7*f* show the operation of the print head of FIGS. 6*a*–6*c;*

FIGS. 6*a*, 6*b*, and 6*c* show an inkjet print head 400 of the continuous type in top view, side view and end view, respectively. The print head has a plurality of nozzles 402 formed in a membrane 404 in contact with an ink cavity 406. The ink cavity has an inlet port 408 and an outlet port 410, each with a valve 412 and 414, respectively, as shown in FIG. 7*a*. During printing, inlet port valve 412 is turned so as to interconnect inlet port 408 with a pressurized ink supply 416. In this state, outlet port valve 414 is normally closed, although in some cases, when additional ink for the nozzles is desired, the outlet port valve may be set to connect outlet port 410 to pressurized ink supply 416.

Figure 7B:
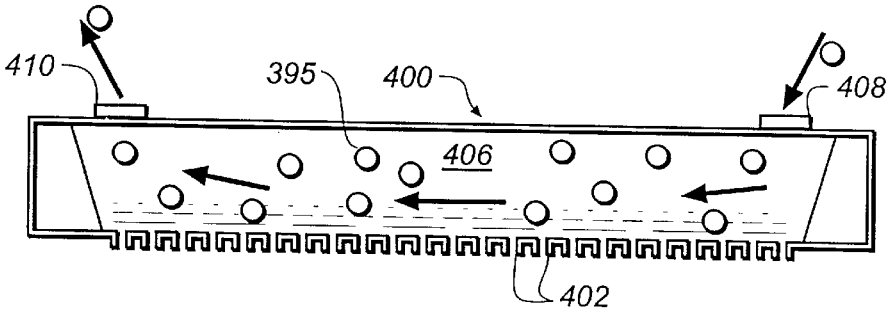
Figure 7C:
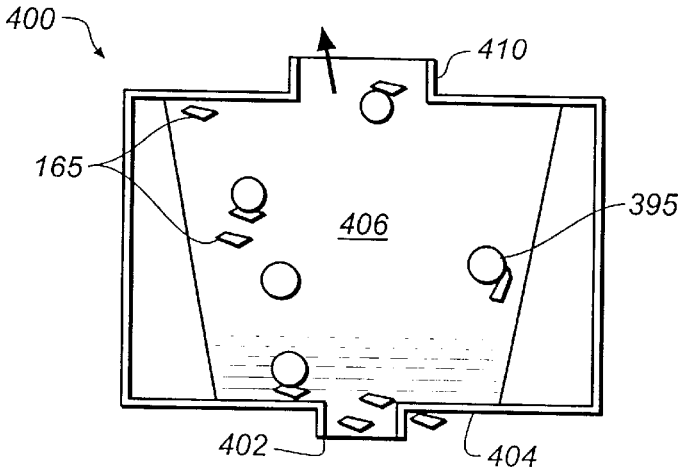

In the cleaning mode, when internal cleaning of print head 400 is desired, inlet port valve 412 is set to connect inlet port 408 with a pressurized cleaning liquid supply 418. If it is desired to clean internal ink cavity 406, the outlet port valve 414 is set to connect outlet port 410 to a removal port 420, such as a port having a vacuum or partial vacuum, so as to draw the cleaning liquid along the print head cavity as shown in FIGS. 7*b* and 7*c*. If the cleaning liquid pressure is sufficiently low, surface tension of the cleaning liquid may prevent the cleaning liquid from flowing out nozzles 402.

Figure 7D:
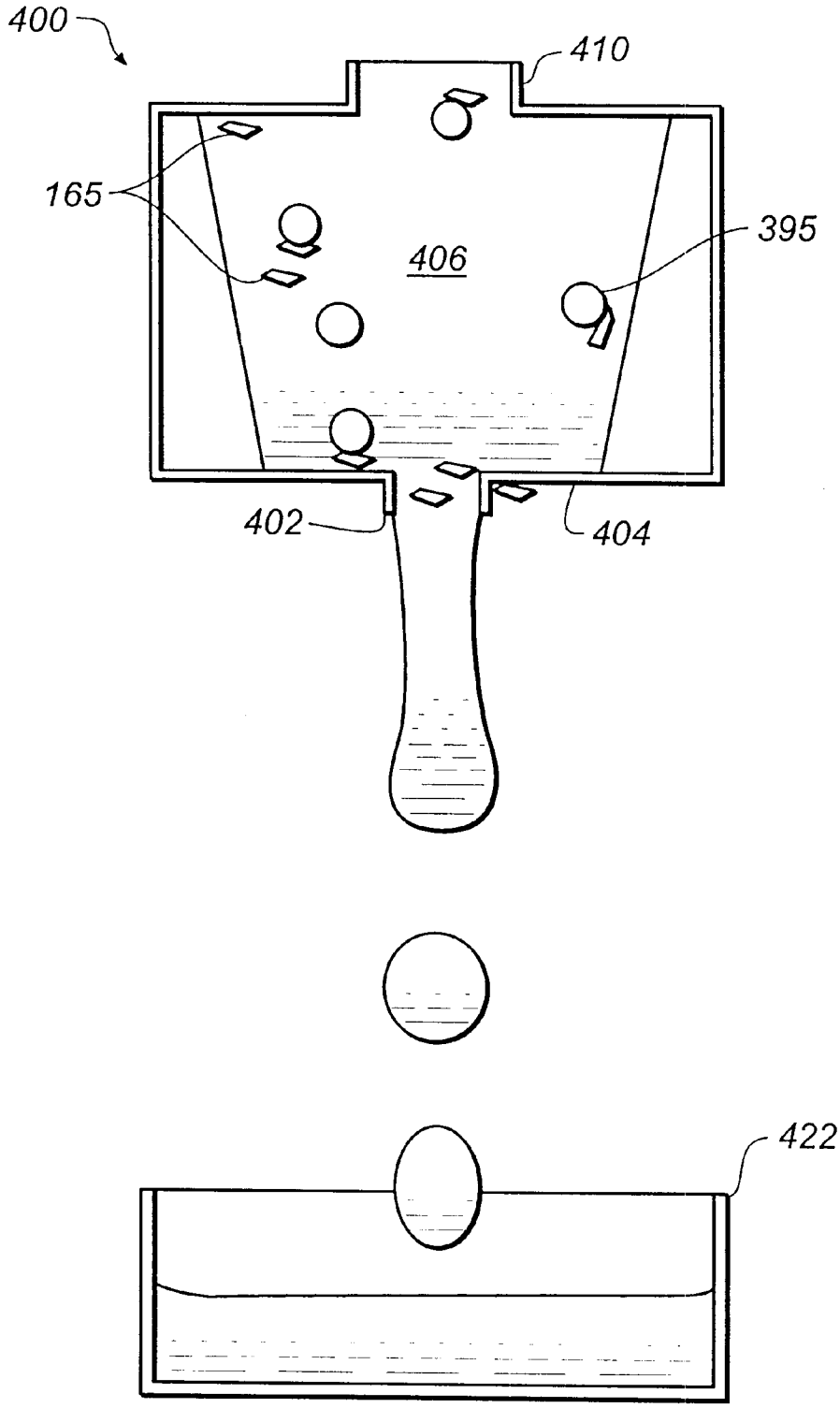
Figure 7E:
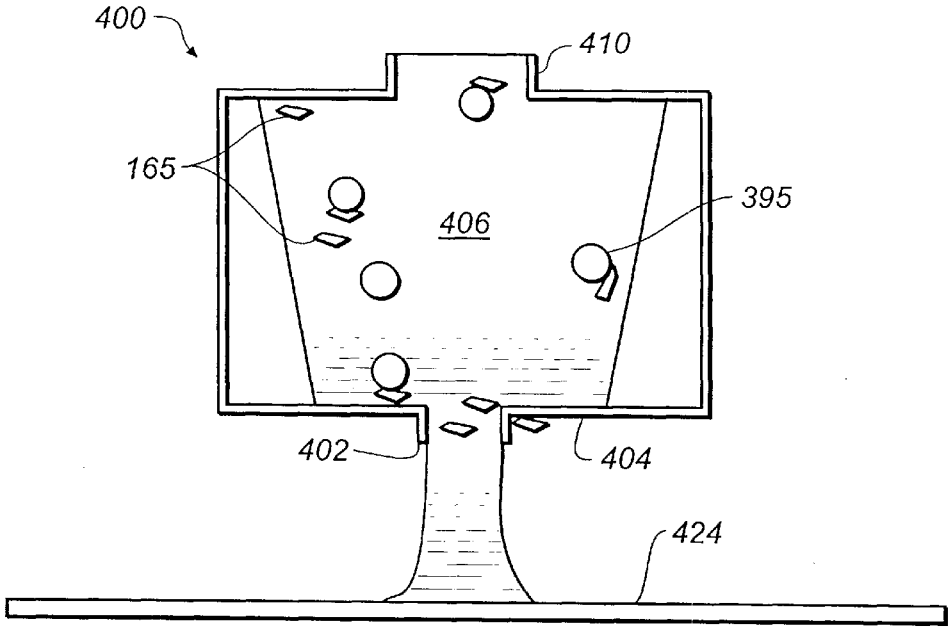
Figure 7F:
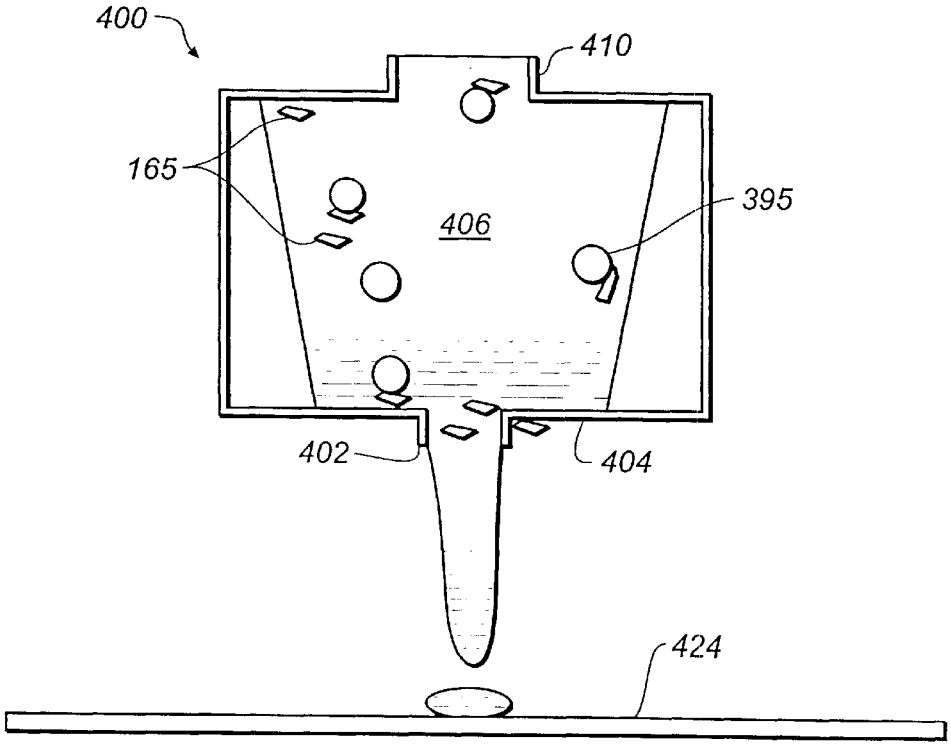

If the cleaning liquid pressure is made sufficiently large by reducing the degree of vacuum in a removal port 420, for example, or by setting outlet port valve 414 during cleaning to connect outlet port 410 to pressurized cleaning liquid supply 418, then some or all of the cleaning liquid will exit the cavity through nozzles 402 as illustrated in FIG. 7*d*. The liquid passing though the nozzles will thereby cleaning the nozzle bore regions. In this case, the expelled cleaning liquid may be captured in a receiver cup 422 or upon a print receiver 424 in regions where no image is to be printed, as illustrated in FIGS. 7*e* and 7*f*). The receiver may in this case be positioned sufficiently close to the nozzles that expelled cleaning liquid contacts the receiver before breaking into discreet drops, as in FIG. 7*e*, or it may be positioned further from the nozzles so that the cleaning liquid breaks into drops before contacting the receiver. In either case, it is advantageous that the print head be moved over the receiver so as to prevent the cleaning liquid from building up. In some cases, it may be desired to ensure that the particles do not pass through nozzles 402, for example if there is concern that the cleaning particles themselves might lodge permanently in the nozzle for nozzles of certain shapes or nozzles made from certain materials. In these cases, the solid cleaning particles may be chosen to be of a large size, for example at least twice as large in diameter as the diameter of the nozzle, so that particles do not pass through nozzles 402. In other cases, it may be desirable that the cleaning particles be selected to be substantially smaller than the nozzle diameter, for example, less than half the nozzle diameter, in order to ensure that groups of particles simultaneously passing through the nozzles do not become lodged.

Figure 8:
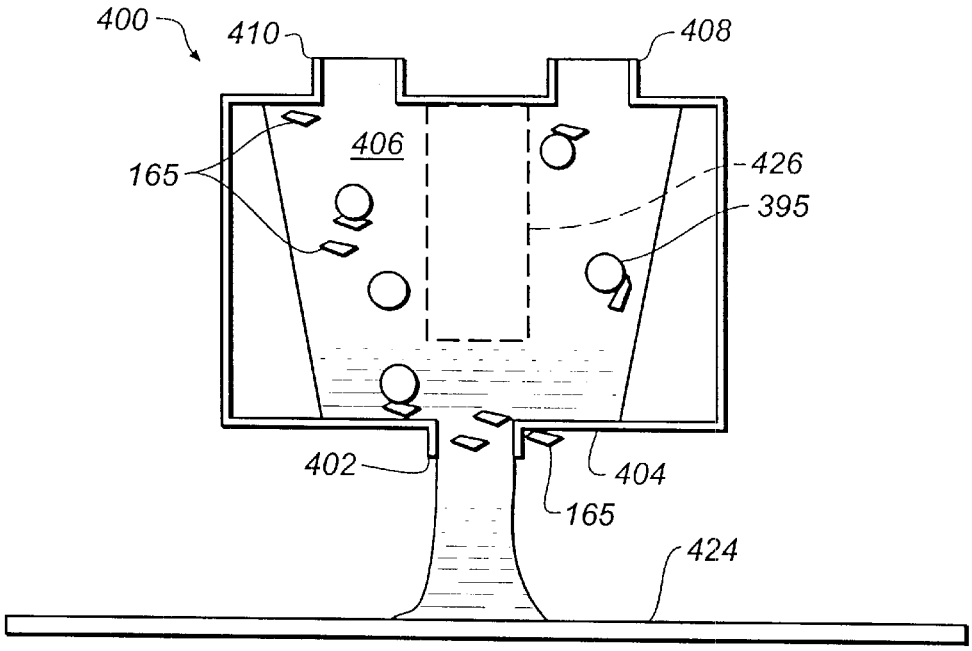
FIG. 8 shows the operation of a print head similar to that of FIGS. 6*a*–6*c;*

In FIG. 8, a print head is shown having a septum 426 between inlet port 408 and outlet port 410. In this case, when cleaning liquid flows from the inlet port to the outlet port, possibly with some additional flow out nozzles 402, the presence of septum 426 causes hydrodynamic shear in the vicinity of the back of nozzles. Such shear enhances cleaning by increasing the liquid velocity in region immediately below the bottom of the septum.

Figure 9:
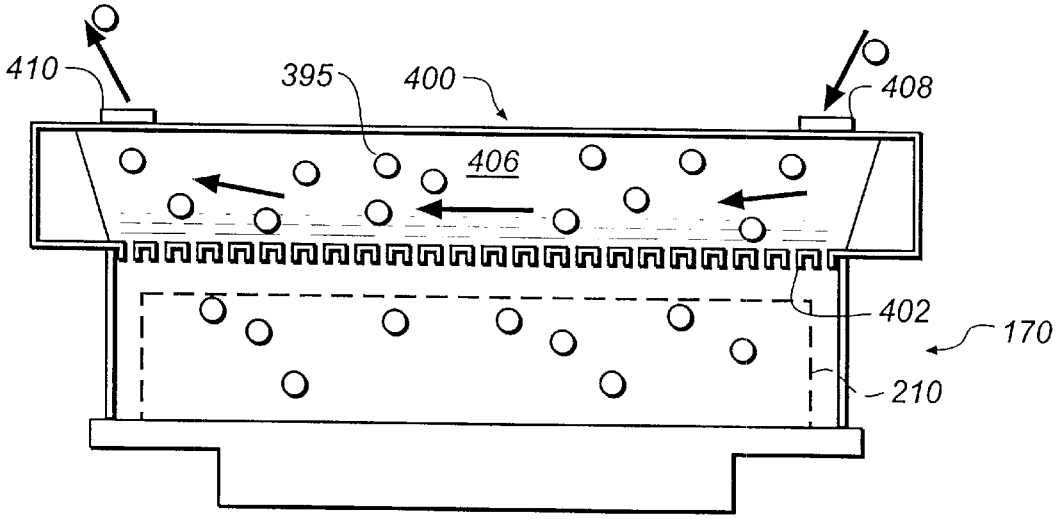
FIG. 9 shows a combination of internal and external cleaning.
Figure 10A:
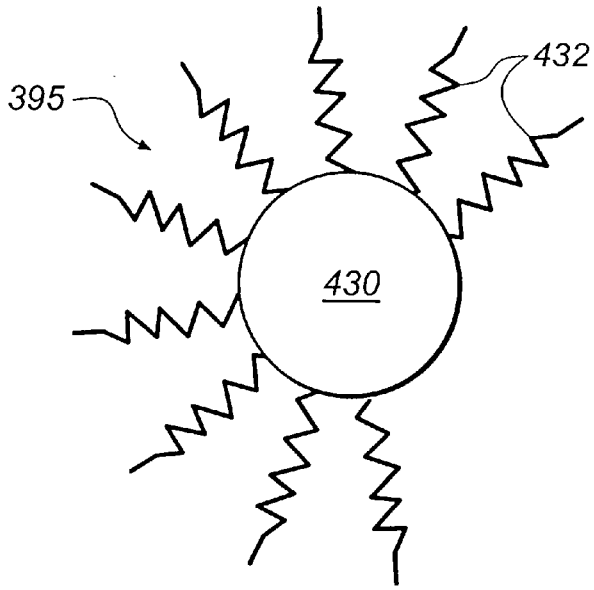
FIGS. 10*a* and 10*b* are enlarged views of solid cleaning particles in a print head.
Figure 10B:
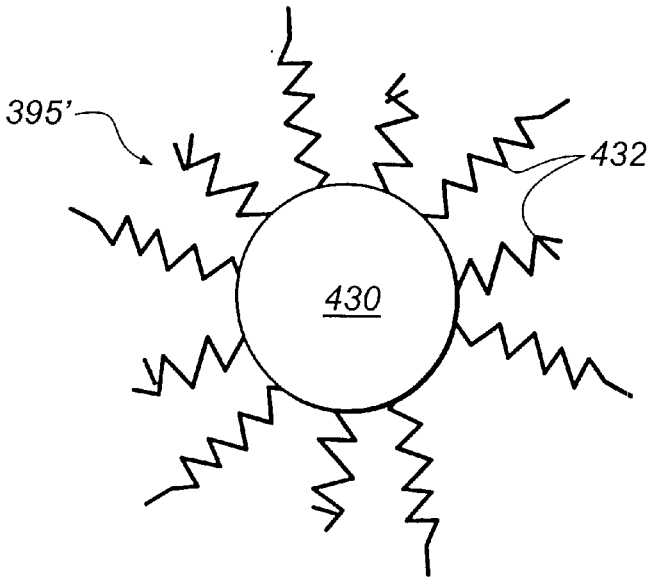

FIG. 9 shows a combination of internal and external cleaning. Cleaning liquid is circulated in ink cavity 406 of print head 400 via inlet port 408 and outlet port 410. Cleaning liquid is also circulated over external surfaces of nozzles 402 on the side opposite ink cavity 406 by a cleaning assembly 170 of the type shown in FIGS. 4 and 5. In this case, it is also additionally possible to clean the inner surfaces of the nozzle bores by forcing liquid from cleaning assembly 170 into ink cavity 406 by sufficient pressure in the cleaning chamber, or conversely. In all these cases, it is desirable after a satisfactory degree of contaminant cleaning has been achieved, to flush out any remaining contaminants attached to cleaning particles and any remaining cleaning particles themselves from the surfaces of the sidewalls 79*a* and 79*b*, coverplate 80, surfaces 85, orifices 90, and any other surfaces exposed to the cleaning particles by circulating a fluid having no solid cleaning particles throughout these regions, as described in the first embodiment for cleaning of the printhead surface in the gap region 220. FIGS. 10*a* and 10*b* are expanded views of a pair of cleaning particles 395 and 395', respectively. Each particle is a bead 430 which may contain surfactants (functionalized surface elements) attached to a portion of the bead and extending from its surface. Beads 430 may be made of polymer such as polystyrene, methylmethacrylate and divinylbenzne, or copolymer such as styrene-divinylbenzene, methylmethacrylate-methacrylic acid, quaternernized vinyl chlorobenzene, and polymethylsilsesquioxane. Alternatively bead 430 may be made of metal such as gold or silver, metal oxides such as silicon oxide, and metal carbonates. Beads 430 are preferably larger than about 1 micron and contain no materials, such as ink, that might tend to be themselves contaminates. It is preferable that at least a portion of the solid particles contain functionalized surface elements 432 comprising polymer chains attached at one end to the beads such that the functionalized surface elements can bond to contaminants. The functionalized surface elements of FIG. 10*a* may be of the type which bond chemically to any number of contaminants or groups of contaminants or to specific contaminants (such as acrylates, polyvinyl alcohols, siloxanes and urethanes) or of the type which bonds electrostatically (such as carboxylate groups, quaternary ammonium sulfates and sulfonates, pyridinium ions, etc.). Polymer beads may be infused with surfactants carrying the desired functional groups. The functionalized surface elements of FIG. 10*b* include elements of both types. Contact of the cleaning particles and their associated functionalized surface elements with the contaminants removes most contaminants by physically dislodging them. If the cleaning particles bond, either momentarily or permanently, to the contaminants, the flow of the rest of the cleaning solution exerts a force on the cleaning particle that is transmitted to the contaminant and helps dislodge it. If the contaminant is dislodged, it is swept away in the flow of cleaning fluid, whether or not it is bonded to the cleaning particles. In some cases, it is preferred that multiple types of flinctionalized surface elements (surfactants) be present on a single particle, types for example which may bond to different contaminants or groups of contaminants or types which may bond to contaminants in different ways, such as chemically or electrostatically. In other cases, it is preferred that each particle contain only a single type of functionalized surface element but that the cleaning solution contain particles some of which have different flinctionalized surface elements than others. It may also be desirable to employ flinctionalized surface elements which attach directly to ink molecules, since contaminants may be assumed likely to contain ink molecules. Also, because the forces exerted by the flow of the cleaning liquid on the solid cleaning particles in general depends on the size of the cleaning particles and because the forces required to dislodge contaminants may in general vary from one region of contamination to another, it is in some cases preferred that the solid cleaning particles have a distribution of sizes. Similarly, since the degree of rotational motion of particles in a flowing liquid depends on the shape of the particles and since the rotation of cleaning particles may assist dislodging them, it is in some cases preferred that the solid cleaning particles have a distribution of shapes, specifically, some being elongated.

While in some cases it is desired that the cleaning solution contain a mixture of many types of cleaning particles with many different functionalized surface elements in order to clean as many types of contaminants as possible, it may also be desirable in certain cases that the cleaning particles be of only one type, for example if it is known that the primary contaminants are of a single type. Similarly, if the primary contaminants are known to be of only a few types, it is preferred that two or more different cleaning solutions be passed sequentially through the regions to be cleaned, each cleaning liquid having cleaning particles of only one type, designed in conjunction with the liquid solvent portion of the cleaning liquid so as to maximize the cleaning of a particular contaminant. In these cases, additional reservoirs and valves are required to change cleaning solutions, as would be appreciated by one skilled in the art of fluid control.

While in many cases it is desirable that the cleaning liquid be pumped at a constant rate, usually a large rate, in order to subject contaminants to a large, constant frictive force from contact with solid cleaning particles in the cleaning liquid, it may be desirable in certain cases to flow the cleaning liquid at two different flow rates, a fast rate and a slow rate, in order that the process of attachment of cleaning particles to contaminants can occur more certainly, without the interference of large forces on the particles from the flow of the liquid. In accordance with this embodiment, after attachment has occurred with certainty, a higher flow rate is then useful in order to subject contaminants to a large frictive force. The slow rate is preferably at least a factor of two slower than the fast rate. More than two rates of flow may also be useful in optimizing cleaning for cases in which a range of contaminants is anticipated.

Figure 11:
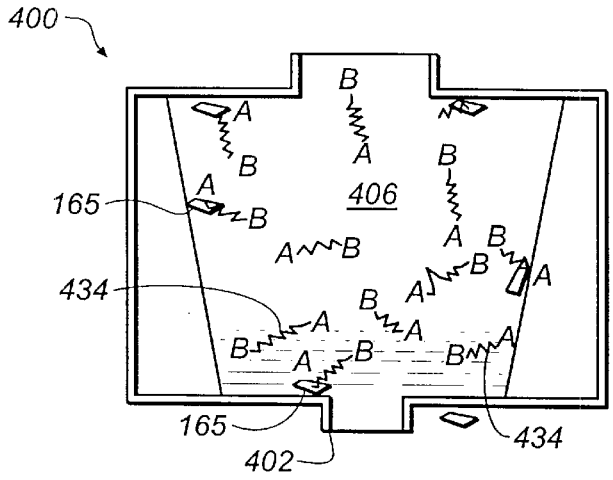
FIG. 11 is a sectional view of a print head with cleaning liquid and cleaning particles.
Figure 12:
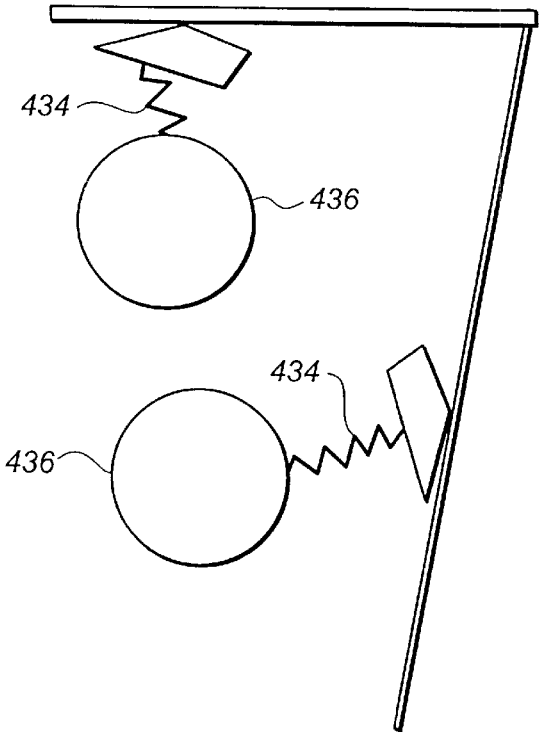
FIG. 12 is an enlarged view similar to FIG. 11.

FIG. 11 shows a case similar to that of FIG. 10 but for a more complex sequence of cleaning operations. In this case, polymers 434 having functionalized surface groups at opposed ends are dispersed in a cleaning liquid containing no solid cleaning particles. One end, an "A" site is chosen so as to attach to the contaminants and the other end, a "B" site is chosen so as to attach to the surface of solid cleaning particles 436 (FIG. 12) later introduced. In accordance with this method, a cleaning liquid having polymers 434 with functionalized surface groups "A" and "B" but having initially no solid cleaning particles is introduced to the print head in a manner similar to that used in the cases of the cleaning liquids discussed previously. Then, after a time delay, the same cleaning liquid but without polymers having functionalized surface groups is flushed through the print head regions to be cleaned until the only remaining functionalized polymers are those which are bound at their "A" sites to contaminants 165. Finally, in a last cleaning stage shown in FIG. 12, solid cleaning particles 436 whose surfaces are ready to bind with "B" sites are introduced into the flowing cleaning liquid. These solid cleaning particles 436 are rapidly bound to the free ends of the captured polymers 434 and are carried off in the cleaning liquid by hydrodynamic forces acting on the particles.

In yet another embodiment, a more complex sequence of cleaning operations involves flowing a second cleaning liquid through or about the printhead surfaces, after the first cleaning liquid has been and flushed. The cleaning particles in the second cleaning liquid are designed to adhere primarily to the cleaning particles of the first cleaning liquid. For example, in this case, functionalized surface elements attached to the second cleaning particles may be designed to have their free ends attach only to particular functionalized surface elements deliberately placed on the first cleaning particles. In this way a number of second cleaning particles may become attached to any remaining first cleaning particles which may be attached to contaminants not dislodged and flushed away or to any remaining first cleaning particles which themselves have become lodged on the printhead surfaces even in the absence of contaminants, thereby increasing the effective forces which the flow of cleaning liquid applies to remaining first cleaning particles. Similarly, other means of increasing the effective forces which the flow of cleaning liquid applies to cleaning particles may be usefully employed. For example, during cleaning, an agent in the cleaning solution such as a dispersive agent, commonly used to prevent aggregation may be removed or deactivated, thereby allowing controlled aggregation of the remaining cleaning particles to occur.

While the invention has been described with particular reference to its preferred embodiments, it will be understood by those skilled in the art that various changes may be made and equivalents may be substituted for elements of the preferred embodiments without departing from the invention. In addition, many modifications may be made to adapt a particular situation and material to a teaching of the present invention without departing from the essential teachings of the invention.

PARTS LIST

H . . . height of seal $P_1$ . . . first height of adjustable septum $P_2$ . . . second height of adjustable septum
W . . . greater width of fabricated septum
X . . . greater length of fabricated septum
$Y_1$ . . . first width of adjustable septum
$Y_2$ . . . second width of adjustable septum
10 . . . printer
20 . . . image
30 . . . receiver
40 . . . platen roller
50 . . . platen roller motor
55 . . . first arrow
60 . . . print head
65 . . . print head body
70 . . . channel
75 . . . channel outlet
77 . . . ink body
79*a*/*b* . . . side walls
80 . . . cover plate
85 . . . surface (of cover plate)
90 . . . orifice
100 . . . meniscus
105 . . . ink droplet
107 . . . first axis
110 . . . transport mechanism
15*a*/*b* first and second position (of print head)
120 . . . guide rail
130 . . . drive belt
140 . . . drive belt motor
150 . . . encoder strip
160 . . . controller
165 . . . contaminate
167 . . . second axis
170 . . . cleaning assembly
180 . . . housing
190 . . . cup
195 . . . open end (of cup)
197 . . . cavity
200 . . . seal
210 . . . septum
215 . . . end portion (of septum)
220 . . . gap
230 . . . inlet chamber
240 . . . outlet chamber
250 . . . piping circuit
260 . . . first piping segment
270 . . . reservoir
280 . . . second piping segment
290 . . . recirculation pump
295 . . . second arrows
300 . . . first filter
310 . . . second filter
320 . . . first valve
330 . . . second valve
340 . . . third piping segment
350 . . . sump
360 . . . suction pump
370 . . . third valve
380 . . . elevator
395 . . . cleaning particles
400 . . . print head
402 . . . nozzles
404 . . . membrane
406 . . . ink cavity
408 . . . inlet port
410 . . . outlet port
412 . . . valve
414 . . . valve
416 . . . ink supply
418 . . . cleaning liquid supply
420 . . . removal port
422 . . . receiver cup
424 . . . print receiver
426 . . . septum
430 . . . bead
432 . . . functionalized surface elements
434 . . . polymers
436 . . . cleaning particles

What is claimed is:

1. A self-cleaning printer, comprising:

a print head having a surface thereon, said surface being susceptible to a contaminate build up of contaminate;

a source of cleaning liquid containing a concentration of macroscopic cleaning particles; and a delivery system providing a flow of the cleaning liquid and the cleaning particles in frictive contact with the contaminate such that a combined effect of frictive force and hydrodynamic shearing force acting on the contaminate effectively removes the contaminate from the surface.

2. A self-cleaning printer as set forth in claim 1, wherein the cleaning particles are adapted to attach to the contaminate.

3. The self-cleaning printer of claim 2, wherein the cleaning particles are polymeric beads.

4. The self-cleaning printer of claim 2, wherein the cleaning particles are polystyrene spheres.

5. The self-cleaning printer of claim 2, wherein the cleaning particles are metal.

6. The self-cleaning printer of claim 2, wherein the cleaning particles are metal oxide.

7. The self-cleaning printer of claim 2, wherein the cleaning particles are metal carbonate.

8. The self-cleaning printer of claim 2, wherein the cleaning particles have surfaces to which polymeric chains are attached, said polymeric chains have end groups which adhere to the contaminate.

9. A self-cleaning printer as set forth in claim 8, wherein the cleaning liquid is adapted flush out both the cleaning particles and the contaminate.

10. The self-cleaning printer of claim 8, wherein the cleaning particles are polystyrene spheres.

11. A self-cleaning printer as set forth in claim 2, wherein the cleaning liquid contains a plurality of types of cleaning particles, each cleaning particle type having attached to it a different surfactant which is adapted to attach to a respective type of contaminant.

12. A self-cleaning printer as set forth in claim 2, wherein each cleaning particle has attached thereto a plurality of different surfactant types.

13. A self-cleaning printer as set forth in claim 2, wherein the cleaning liquid contains a plurality of types of cleaning particles, each cleaning particle type being a size different from the size of the other cleaning particle types.

14. A self-cleaning printer as set forth in claim 2, wherein cleaning particles of a first type attach to contaminants and cleaning particles of a second type attach to the cleaning particles of the first type.

15. A self-cleaning printer as set forth in claim 1, wherein the cleaning particles are substantially elongated.

16. A self-cleaning printer as set forth in claim 1, wherein the cleaning particles are larger than the orifices so as to inhibit the particles from passing through or lodging in the orifices.

17. A self-cleaning printer as set forth in claim 1, wherein the cleaning liquid contains surfactant molecules which attach to both the cleaning particles and to the contaminate.

18. A self-cleaning printer as set forth in claim 1, wherein the cleaning particles are substantially smaller than the orifices so as to prevent groups of particles from lodging in the orifices.

19. A self-cleaning printer as set forth in claim 18, further including molecular surfactants designed as to adhere to dye molecules of the ink.

20. A self-cleaning printer as set forth in claim 18, further including further including on each bead a molecular surfactants so designed as to adhere to identical surfactants on other beads when the cleaning liquid is of a type having no dispersive agents.

21. A self-cleaning printer as set forth in claim 1, wherein the particles are metal with absorbed surfactants.

22. A self-cleaning printer as set forth in claim 1, wherein the particles are metal with absorbed polymer having functional groups.

23. A self-cleaning printer, comprising:

a print head having a surface thereon with ink ejecting orifices defined in the surface, said surface and said orifices being susceptible to a build up of contaminate;

a source of cleaning liquid containing a concentration of macroscopic cleaning particles; and a delivery system opposite the surface, said delivery system defming a gap with the surface sized to allow a flow of the cleaning liquid and the cleaning particles in frictive contact with the contaminate such that a combined effect of frictive force and hydrodynamic shearing force acting on the contaminate effectively removes the contaminate from the surface.

24. A method of cleaning a contaminate build up from a printer surface having ink ejecting orifices, comprising the steps of:

providing a source of cleaning liquid containing a concentration of macroscopic cleaning particles; and delivering the cleaning liquid the and cleaning particles in frictive contact with the contaminate build up such that a combined effect of frictive force and hydrodynamic shearing force acting on the contaminate build up effectively removes the printer contaminate from the printer surface.

25. A method as set forth in claim 24, wherein the printer surface has a front side from which ink is ejected; further comprising the step of delivering the cleaning liquid and the cleaning particles to the front side of the printer surface.

26. A method as set forth in claim 24, wherein the printer surface is an outer wall of an interior chamber of a print head; further comprising the step of delivering the cleaning liquid and the cleaning particles to the printer surface from the interior chamber of the print head.

27. A method as set forth in claim 26, further comprising the step of collecting the cleaning liquid and the cleaning particles escaping from the print head into a waste receiver.

28. A method as set forth in claim 24, wherein the printer surface is a surface if a wall defining an interior chamber of a print head, said method further comprising the steps of:

delivering the cleaning liquid and the cleaning particles to the printer surface from the interior chamber of the print head; and providing print media for collecting the cleaning liquid and the cleaning particles escaping from the print head on the print media in regions of the print media where no images are to be printed.

29. A method as set forth in claim 24, wherein the printer surface is a surface of a wall defining an interior chamber of a print head, said method further comprising the steps of delivering to the printer surface from the interior chamber of the print head cleaning liquid with the cleaning particles larger than the size of the orifices whereby the cleaning particles are disposed to flow entirely within the print head.

30. A method as set forth in claim 24, wherein the printer surface is a surface if a wall defining an interior chamber of a print head; further comprising the step of delivering the cleaning liquid and the cleaning particles to the printer surface from a side of the wall such that the cleaning liquid flows into the interior chamber through the orifices.

31. A method as set forth in claim 24, wherein the cleaning liquid and the cleaning particles are delivered at a plurality of flow rates and having a slow rate that is at least a factor of ten less than a fast rate.

32. A method as set forth in claim 24, wherein the step of delivering the cleaning liquid and the cleaning particles is effected such that at least two different types of the cleaning particles are delivered sequentially.

33. A method as set forth in claim 24, wherein the step of delivering the cleaning liquid and the cleaning particles is preceded by a step of delivering a precursor solution containing surfactant molecules with at least two functionalized end groups, one of which attaches to contaminants and another of which attaches to the cleaning particles in the subsequently delivered cleaning liquid, The precursor solution has no the cleaning particles.

* * * * *